United States Patent [19]

Yannopoulos

[11] Patent Number: 4,470,845

[45] Date of Patent: Sep. 11, 1984

[54] CONTINUOUS PROCESS FOR COPPER SMELTING AND CONVERTING IN A SINGLE FURNACE BY OXYGEN INJECTION

[75] Inventor: John C. Yannopoulos, Westport, Conn.

[73] Assignee: Newmont Mining Corporation, New York, N.Y.

[21] Appl. No.: 455,867

[22] Filed: Jan. 5, 1983

[51] Int. Cl.[3] ..... C22B 15/04; C22B 23/00; F27D 17/00

[52] U.S. Cl. ..... 75/23; 75/73; 75/82; 266/144; 423/539

[58] Field of Search ..... 75/23, 73, 74, 75, 82, 75/26; 266/144, 162, 182; 423/539

[56] References Cited

U.S. PATENT DOCUMENTS

| | | | |
|---|---|---|---|
| 3,687,656 | 8/1972 | Maelzer et al. | 75/74 |
| 3,796,568 | 3/1974 | Szekely et al. | 75/75 |
| 4,358,311 | 11/1982 | Weigel et al. | 266/162 |

*Primary Examiner*—M. J. Andrews
*Attorney, Agent, or Firm*—Fred A. Keire

[57] ABSTRACT

A process and apparatus for continuous copper smelting, slag conversion, and production of blister copper in the same furnace by enriched oxygen containing gas injection.

22 Claims, 13 Drawing Figures

FIG. 1 SECTIONAL VIEW OF FURNACE ALONG ITS LONGITUDINAL AXIS.

FIG. 2 CHARGING END OF THE FURNACE.

FIG. 3 BLISTER COPPER DISCHARGING END OF THE FURNACE.

TOP VIEW OF THE FURNACE SHOWN IN FIG. 1

CROSS-SECTIONAL VIEW OF THE FIRST PARTITION 10 (aa' IN FIG. 1)

CROSS-SECTIONAL VIEW OF THE SECOND PARTITION 10 (bb' IN FIG. 1)

PARTIAL CROSS-SECTION BELOW THE SLAG-MATTE INTERFACE (CC' IN FIGS. 1 & 10)

FIGURES 8a & 8e WATER-COOLED COPPER MEMBERS FOR THE FURNACE PARTITIONS.
FIGURE 8b ONE THIRD OF FIRST PARTITION 2
FIGURE 8d ONE THIRD OF SECOND PARTITION 7

FIG. 12
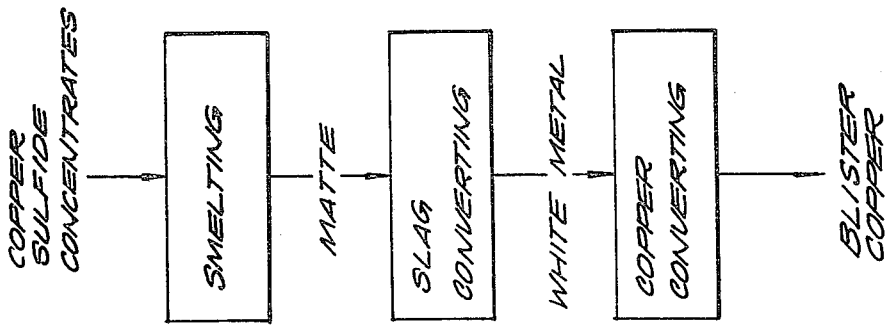
SCHEMATIC FLOW-DIA. GRAM SHOWING THE NECESSARY THREE DISTINCT STEPS FOR BLISTER COPPER MAKING.
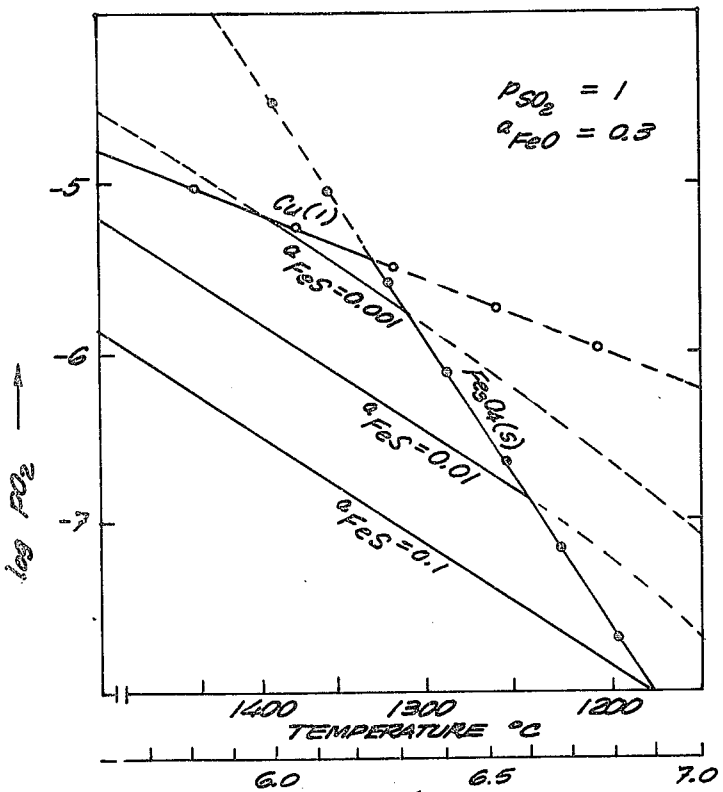
FIG. 11
EQUILIBRIN OF SMELTING REACTIONS AS FUNCTIONS OF TEMPERATURES AND OXIGEN PARTIAL PRESSURE
$FeS_{(l)} + 1.5O_2$ (s) → $FeO_{(l)} + SO_2$ (g) —— (s) = SOLID (a) =
$3FeO_{(SOLN.)} + 0.5O_2$ (g) → $Fe_3O_4$ (g) —•— (l) = LIQUID (SOL) = SOLUTION
$Cu_2S_{(l)} + O_2$ (g) → $2Cu_{(l)} + SO_2$ (g) —o— (g) = GAS (a) =

MATERIAL BALANCE ACCORDING TO THE DESCRIBED PROCESS (ALL VALUES IN TONS PER DAY) (TPD)

CONTINUOUS PROCESS FOR COPPER SMELTING AND CONVERTING IN A SINGLE FURNACE BY OXYGEN INJECTION

This invention relates to a continuous smelting and conversion of copper in a furnace suitable for both smelting and conversion; more particularly, this invention relates to a process and apparatus for copper smelting and conversion in the same furnace by enriched oxygen containing gas injection.

Accordingly, a new furnace is proposed for smelting copper sulfide concentrates to matte and converting the latter, in the same furnace, to produce continuously blister copper. A charge is composed of dry, fine concentrate and ground secondaries, i.e. copper-rich slag concentrates and fluxes. This charge is injected with oxygen into the furnace through a number of oxy-concentrate (oxygen-concentrate) burners. A furnace suitable for this purpose is partitioned in three distinct sections: a first section for smelting and settling, a second section for slag converting, and a third section for copper converting. The converting of matte to blister copper is achieved by injection through lances of oxygen or air enriched in oxygen.

BACKGROUND FOR THE INVENTION

Description of Prior Art a. Conventional Copper Smelting.

The smelting of copper sulfide concentrates has been carried out primarily in reverberatory or electric furnaces. Copper concentrates have been charged in those furnaces either wet or after roasting.

Energy consumption is very significant in these furnaces. Energy is required for heating the charge and supplying the necessary latent heat of fusion to obtain the molten phases of slag and matte. In the reverberatory furnaces, a large volume of combustion gas is produced which, along with the air infiltration into the furnace, leads to a very severe dilution of sulfur dioxide ($SO_2$) produced during smelting. Because a significant fraction of the sulfur in the copper sulfide containing charge (20–35%, by weight on elemental basis of sulfur, for green charge furnaces) is removed during smelting, the consequent production of very large volume of gas, with a low $SO_2$ concentration, makes any attempt to control this diluted sulfur emission very expensive.

A molten matte is mainly composed of copper and iron sulfides. It is transported from the smelting furnace in ladles (by cranes) to P-S (Peirce-Smith) horizontal converters. Air is blown in the P-S converters and, thus, iron is oxidized and removed in a slag phase, whereas sulfur is oxidized to gaseous sulfur dioxide ($SO_2$). The P-S converters are cylindrical furnaces, up to 35 ft. long and with diameter up to 15 ft. A "mouth" at mid-length of the P-S converter serves as a gas exit. Through this "mouth" these furnaces are charged and discharged. During operation, the P-S converter mouth is under a water-cooled hood which collects the $SO_2$-containing gas. As the hood is under a slight negative draft, a significant air infiltration occurs thus diluting strongly the gaseous converter product. This dilution may be reduced at a lower draft, but part of the $SO_2$-containing gas escapes from the hood and pollutes the plant environment.

Fugitive emissions of $SO_2$ gas also occur during the transportation of matte and during charging and discharging of the P-S converter. Secondary hoods—expensive to install and operate—have been employed recently for the collection of these fugitive emissions. Notwithstanding the cost of secondary hoods, the collection of the escaping $SO_2$ gas is often unsatisfactory.

b. Conventional Copper Converting.

The converting of copper matte is a batch operation divided in practice in two stages. Stage one is "converting-for-slag," that is removal of iron and partial removal of sulfur. Stage two is "converting-for-copper," that is completion of sulfur removal from copper and production of blister copper.

During the first stage of converting, iron is oxidized and iron oxides with silica flux form mostly molten silicates of relatively low viscosity.

This "converting-for-slag" stage is composed of several cycles (e.g. 4 to 9, but typically 6 to 8 cycles). At the end of each cycle, slag is discharged, a new quantity of matte is charged, and the converting starts again. Fugitive emissions of $SO_2$ occur during each cycle, and especially during discharging and charging the converter. After the removal of iron, the enriched matte (white metal, about 79% Cu) is converted to blister copper.

c. Flash Smelting Techniques.

New copper smelting plants have adopted flash smelting techniques. A dry charge is blown into the flash furnaces, together with preheated air or oxygen-enriched air or oxygen, to form a suspension of sulfide (and flux) particles within the oxidizing gas medium. Roasting, smelting and partial converting reactions are taking place at an extremely rapid rate. Flash smelting can be autothermal if appropriately adjusted flow rates of oxygen are used. Flash smelting process yields a high grade of matte. A matte, produced in the flash smelting furnace, nevertheless, has to be transported to the converters and oxidized to obtain blister copper employing the same two-stage, multi-cycle, batch operation as in the conventional process.

The slag produced in flash smelting is usually highly oxidized and has high copper content. This slag has to be treated separately for copper recovery therefrom. Flash smelting, in spite of its significant advantages over conventional smelting, has a number of drawbacks.

One drawback is that flash smelting is a multi-step operation with molten sulfides, slags, and blister copper transported by ladle and crane from furnace to furnace.

Another drawback is that periodic tapping of (high grade) matte from the flash smelting furnace is required; this and transportation of the matte to the converters cause fugitive emissions of $SO_2$ gases.

Another drawback of flash smelting is that it still requires the batch operation of P-S converters. The last contributes strongly to fugitive $SO_2$ gas emissions.

A smelter employing flash smelting furnaces has two sources of high concentration $SO_2$ gases, one from the flash smelting furnace and the other from the converters. These gases are often the feed material for an on-site sulfuric acid plant. However, the fluctuations of the converter gas, both in flow rate and $SO_2$ concentration, restrict the efficiency of the acid plant and thus operates as another drawback.

Fundamental Steps In Copper Smelting and Converting

Starting with copper sulfide concentrates, the pyrometallurgical production of copper is a progressive and controlled oxidation reaction. The activity of oxygen (i.e. partial pressure of oxygen in the system, or expressed otherwise-concentration), in the production system, is gradually increased during smelting and converting. Conventional smelters, as well as flash smelters, have produced millions of tons of copper by following three distinct consecutive steps (in separate furnaces):

1. Smelting (at low oxygen activity),
2. Converting-for-slag (high oxygen activity),
3. Converting-for-copper (high oxygen activity in the absence of iron compounds).

The thermodynamic equilibria of the simultaneous oxidations, which take place during copper smelting and converting, require the three-step operation and indicate the conditions that must be respected during pyrometallurgical copper making. These conditions are illustrated in FIG. 11 and will be further discussed. An attempt to oxidize copper sulfide, in the presence of slagged iron, results in the oxidation of iron to magnetite and copper ferrites. A high content of magnetite and copper ferrites in the slag gives a viscous, or quasi-solid slag, with extremely high copper content. This type of slag impedes an efficient production of copper.

Contaminants—such as arsenic, antimony, bismuth are usually found in copper concentrates. A significant proportion of these contaminants dissolves in the matte. If matte contaminated with As, Sb, Bi is converted in the presence of molten metallic copper, those contaminants tend to dissolve in the metal (causing detrimental complications during its subsequent refining). When such contaminated matte is converted in the absence of a metallic phase—as in the stepwise converting—the impurities are oxidized and mixed in the slag phase.

Continuous Copper Smelting Processes

Three continuous copper smelting processes have been tried on a pilot plant scale and two of those are currently in operation. These processes are known as the WORCRA, the NORANDA, and the MITSUBISHI process.

In a WORCRA process, it is suggested to perform smelting and converting in a single furnace, with the matte and slag flowing countercurrently. There is no attempt to partition the furnace into distinct smelting and converting zones. The WORCRA process, after long pilot plant testing, failed to develop as an industrial process.

The NORANDA process proposed the continuous production of blister copper and rejectable slag in a cylindrical furnace equipped with tuyeres (similar to an elongated and modified P-S converter). The proposed reactor is indicated as composed of three zones (smelting, converting and slag cleaning), but without any distinct partition between these zones and under a common gas space throughout. Industrial tests failed to produce a "clean" rejectable slag. A viscous slag, high in magnetite and copper contents, was produced. This slag required further treatment outside the reactor. In addition, concentrates contaminated with As, Sb, and Bi yielded blister copper containing these contaminants, thus causing difficulties in the subsequent refining of the metal.

Consequently, the NORANDA process, as operated industrially, is not a continuous copper-making process. The NORANDA reactor is a smelting furnace producing high grade matte (to be converted) and slag with very high copper content (to be treated in an additional operation).

The third process, known as the MITSUBISHI process, employs three interconnected furnaces. In this process smelting is distinctly separated from converting, thus single stage converting is employed, i.e. in a separate furnace, in the presence of molten copper phase. However, the three-furnace concept maximizes heat losses. Further, the movement of molten materials from furnace to furnace leads to fugitive emissions of $SO_2$ gas.

For today's copper production, a clean environment with low energy consumption is a desideratum. The increasingly stricter regulations for controlling sulfur emissions and for operating environmentally "clean" plants require the development of a continuous copper smelting and converting process in a single furnace, with a single source of effluent $SO_2$ gas. The high cost of energy is a strong incentive for the development of an autothermal process (utilizing the heat of oxidation of iron and sulfur) within a single furnace and for the production of a low volume of gas (with high $SO_2$ content).

BRIEF DESCRIPTION OF THE INVENTION

It has now been found that a new smelting and converting furnace, as disclosed herein, contributes significantly to overcoming the above-described shortcomings. In this furnace, the dry charge is injected with oxygen through a number of oxy-concentrate burners. This furnace is separated by partitions in three intercommunicating but distinct sections for smelting, slag converting, and copper converting.

The first partition separates the gas space between smelting and converting and prevents the smelting slag from flowing into the converting sections. The second partition prevents the flow of the converting slag into the copper converting section, but it allows the outflow of the gas towards desirably a single gas-exit of the furnace. Matte can flow from section to section under both partitions.

Smelting and partial converting are taking place in the first section of the furnace, where slag and matte flow countercurrently or co-currently. Converting of matte in two stages is caused by oxygen injection, through lances, in the converting sections. Almost all of the iron in the matte, along with any contaminants such as As, Sb, Bi, Pb, Zn, etc., are removed as a fluid slag from the first stage of converting. The enriched matte flows into the copper converting section and is further converted to blister copper, which, being heavier, settles at a recessed bottom of the last section and outflows continuously through a tap hole.

The present discovery achieves the continuous production of blister copper and low-in-copper-slag in a single furnace with a single gaseous product stream (at constant flow rate, and with a high $SO_2$ content). Moreover, the process can be designed to operate autothermally. The transportation of molten masses, within the smelter, is restricted to a minimum; converters and cranes serving them are eliminated. Thus, most of the sources of fugitive sulfur dioxide gas within the plant cease to exist. Hence, the apparatus can claim significant savings in energy and in costs for controlling sulfur emissions.

Various embodiments of the disclosed apparatus and the process of continuous smelting and converting by progressive oxidation, such as by injection of oxygen, will be better understood from the following description, in conjunction with the accompanying drawings, wherein.

Figure 5:
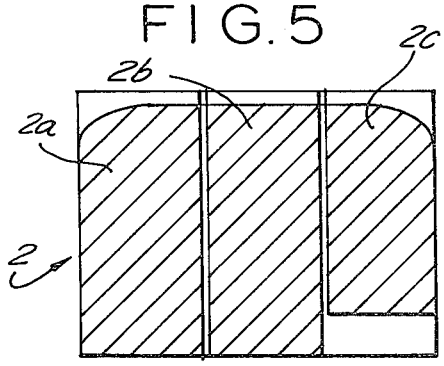
FIG. 5 is a cross-sectional view of the first partition of the furnace along lines aa in FIGS. 1 and 10.
Figure 6:
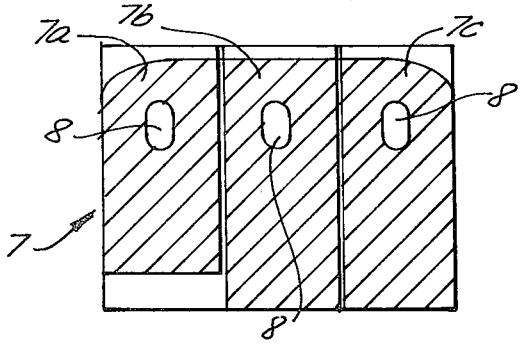
FIG. 6 is a cross-sectional view of the second partition of the furnace along lines bb in FIGS. 1 and 10.
Figure 7:
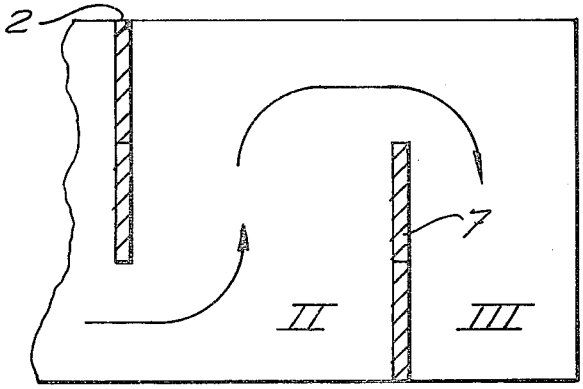
FIG. 7 is a partially longitudinal top plane view along cross-sectional line cc, shown in FIGS. 1 and 10, the partial view illustrating the converting parts of the furnace below the slag-matte interface (cc in FIGS. 1 and 10), and schematically, by arrows, showing the directional movement of the matte.
Figure 8:
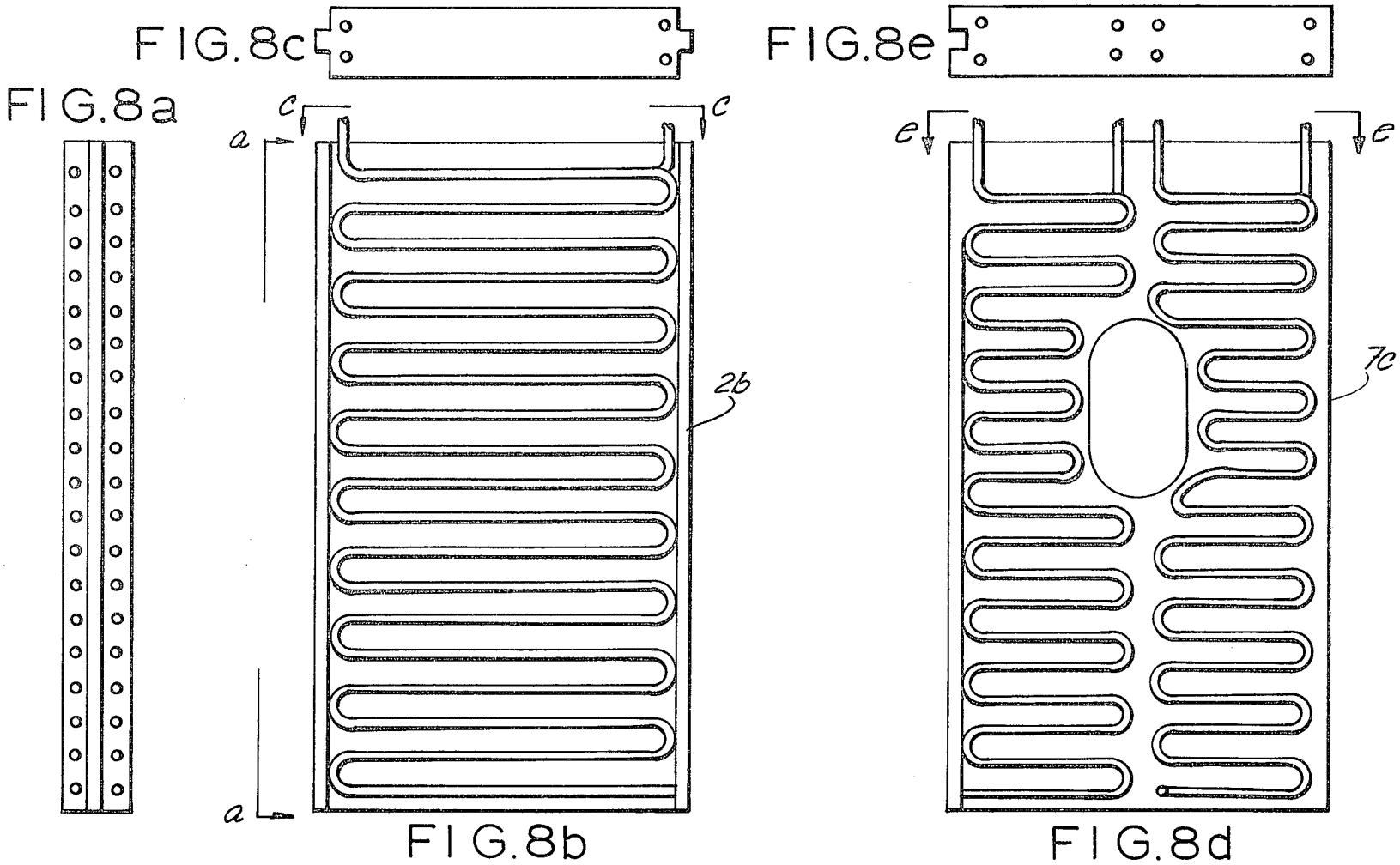
Figures 9, 10:
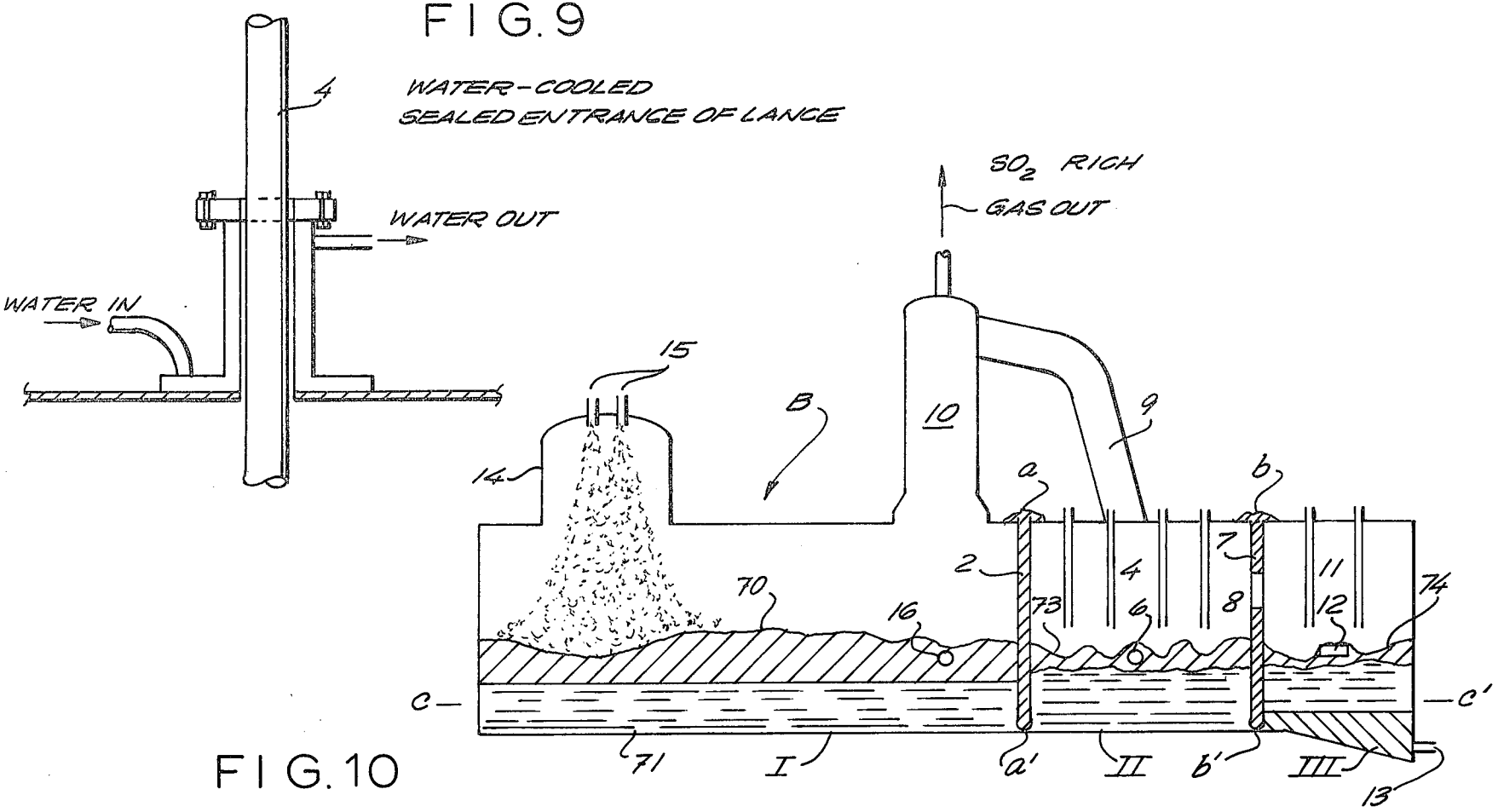
Figure 13:
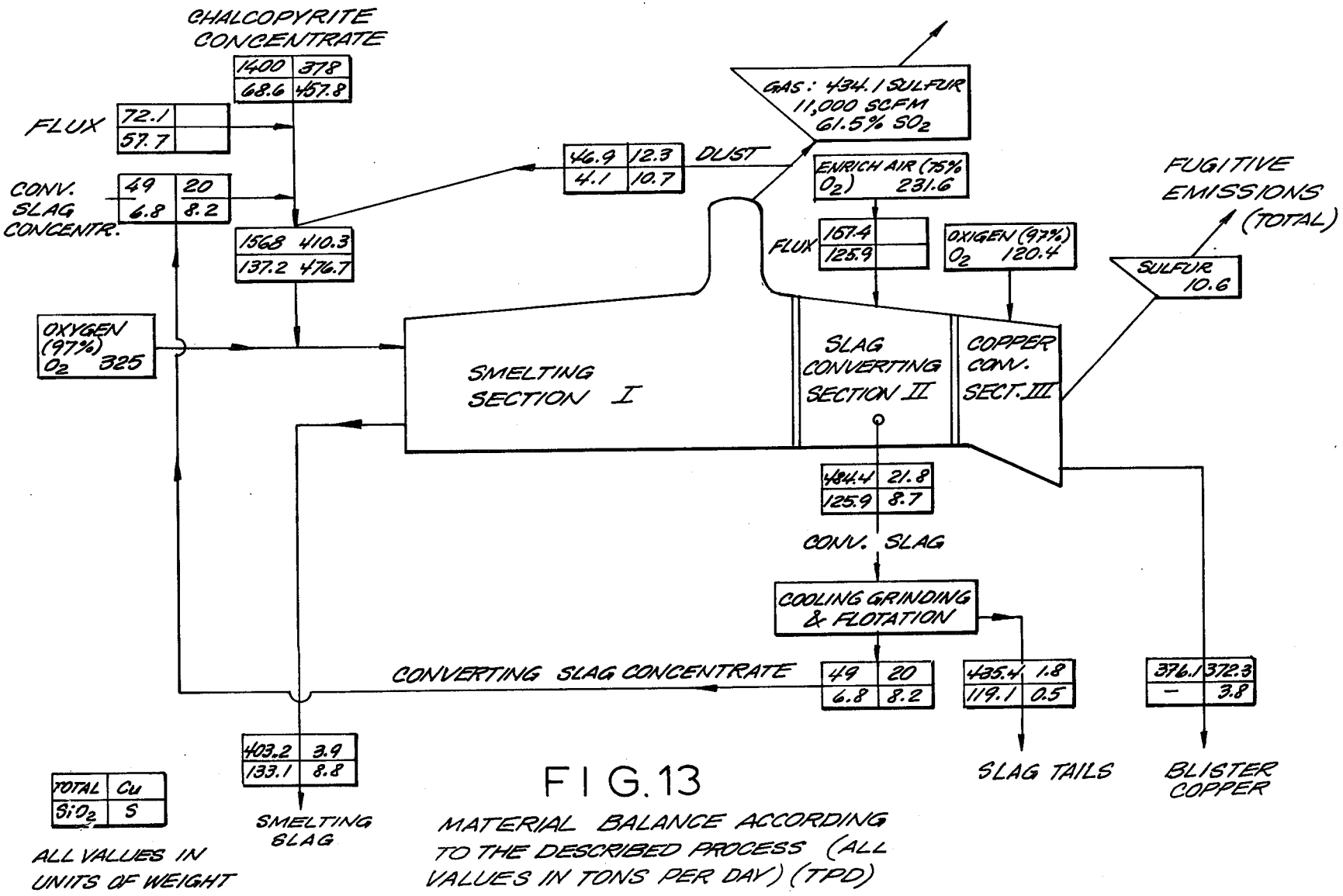

FIGS. 8(*a*) to 8(*e*) are schematic drawings of the front and various cross-sectional views of the water-cooled copper members for the partitions depicted in FIGS. 5 to 7;

FIG. 9 is a schematically depicted cross-sectional view of a lance and its entrance into the furnace;

FIG. 10 is a sectional view of another embodiment of the furnace shown as Furnace B along the longitudinal axis depicting a furnace design where a concentrate charge is injected from the top of a short shaft and the matte and slag flow co-currently;

FIG. 11 presents equilibrium curves of each of the main converting reactions as a function of partial pressure of oxygen versus temperature, at decreasing activity (i.e. concentration) of iron sulfide;

FIG. 12 is a schematic flow diagram showing the three distinct steps which are necessary to produce blister copper from copper sulfide concentrates, and FIG. 13 is a material flow balance depicting the application of this invention.

MORE DETAILED DESCRIPTION OF THE INVENTION AND THE PREFERRED EMBODIMENTS

Figure 1:
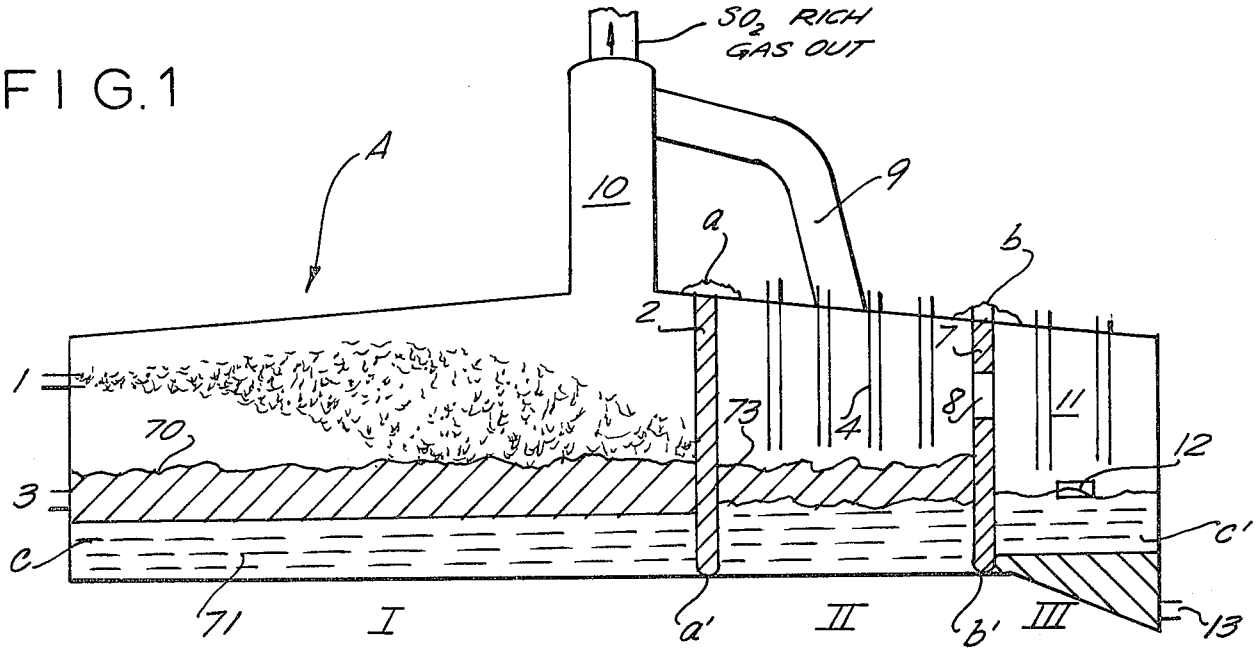
FIG. 1 is a sectional view of the described furnace A along its longitudinal axis.

The charge to the furnace A, as shown in FIG. 1, is composed of fine copper sulfide concentrate mixed with recovered dust which is recycled, ground secondary concentrates and the appropriate ground fluxes. With reference to FIG. 13, the schematic material balance flow sheet, the charge constituents, including recycle streams, recovered dust, and flux, are aptly illustrated. The charge is thoroughly dried to a moisture content of less than about 2%, preferably to about 1%. The thus dried charge is injected into the furnace (FIGS. 1, 4 and 10), in admixture with oxygen, through a number of oxy-concentrate (oxygen-copper sulfide concentrate) burners, depicted as item 1. These burners are of simple design and are well known in the art. The gas suspended dry concentrate solids react very fast with oxygen. The particle size of the solid charge is typically from 10 to 325 or more mesh, (U.S.); finer sizes are preferred.

As previously discussed, the furnace A, shown in FIG. 1, is divided into three distinct sections labeled as I, II and III; these are: I. smelting and settling section; II. slag converting section, and III. copper converting section.

The three sections I, II, and III of furnace A are created by two partitions (labeled as items 2 and 7 in both FIGS. 1 and 10), and each of these partitions 2 and 7 consist of three water-cooled copper blocks, 2*a*, *b*, and *c* and 7*a*, *b* and *c*, respectively, as shown in detail in FIGS. 5 to 8(*e*), or water-cooled refractory walls, of adequate dimensions. The first partition 2 is designed to separate the gas space between smelting section I and converting sections II and III. Partition 2 is also to prevent the smelting slag 70 from flowing into the converting section II. Matte 71, however, is allowed to flow under one-third of the first partition 2 (FIGS. 5 to 7) into the slag converting section by appropriately designing one of the three partition members 2(*a*) to 2(*c*) and 7(*a*) to 7(*c*) as shown in FIGS. 5 to 6, respectively.

Figure 2:
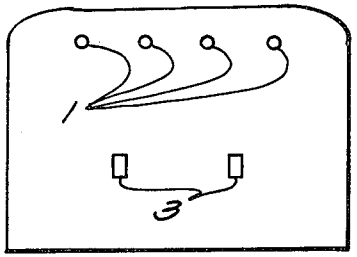
FIG. 2 is the left end view of the furnace, shown in FIG. 1, schematically illustrating the end of the furnace for the oxy-concentrate burners used for feeding the furnace.

The ratio of oxygen to charge is adjusted, on the basis of the charge composition, to produce the desirable grade of matte. Typically, the grade of matte is preferably between 45% and 50% copper, by weight, and should be such as to allow a maximum removal of iron with a smelting slag 70 of an acceptably low copper content, e.g. from 0.4 to 1.2%. Slag 70 and matte 71 flow countercurrently in the smelting section I in the FIG. 1 furnace A. Slag 70 is skimmed from the end wall, depicted in FIG. 2 of the smelting section I, whereas matte 71 underflows into the slag converting section II. Skimming of slag is accomplished through tap openings 3 in the left end of furnace A, as depicted schematically in FIG. 2.

The thermal balance of the smelting section I may be controlled by regulating the grade of matte, such as from about 40 to about 55%, preferably to about 45 to 50%, based on the percent of copper in the matte, and/or recycling a (small) part of the converter slag (from converting section II) after granulation and grinding of this slag. (If the percentage of copper in the matte exceeds about 55%, then the copper loss in the slag becomes economically prohibitive, i.e. the slag must be treated to recover the copper content.) Such recycled slag is in an amount of about 10 to 20% of the slag produced in section II.

Figure 4:
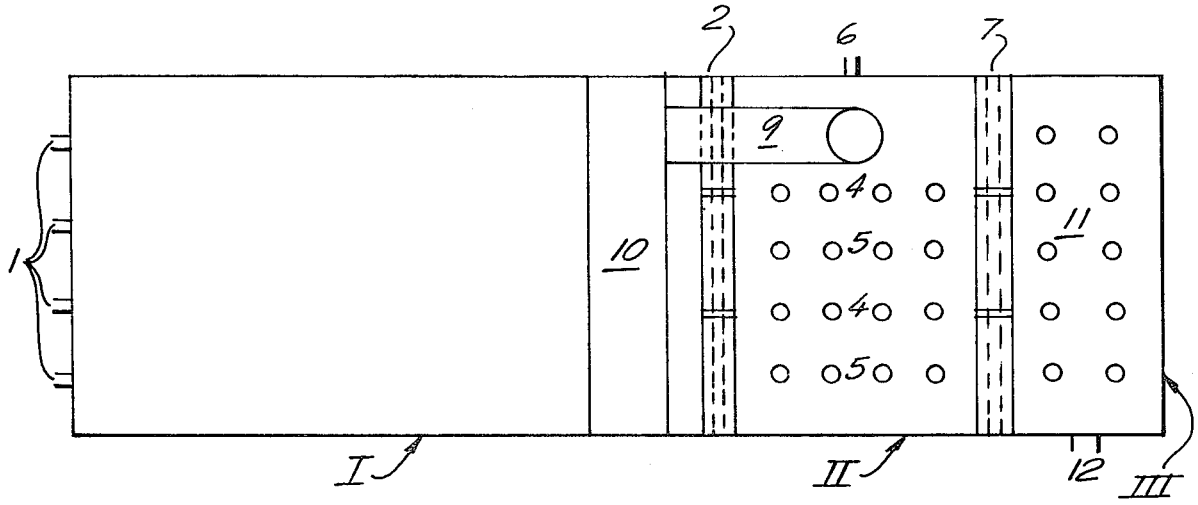
FIG. 4 is a longitudinal top view of the furnace, shown in FIG. 1, schematically illustrating, inter alia, the positions of lances used for oxygen injection.

Oxygen is injected via lances 4, through the furnace A or B (the last shown in FIG. 10) roof, for the converting of matte 71. A number of flux lances 5 are used to inject ground silica flux with oxygen into converting section II. A fluid slag 73 is thereby formed. Oxygen lances 4 and flux lances 5 alternate either by row or by column as shown in FIG. 4. The numbers of lances are as required based on size and operating experience. Slag 73 and enriched matte 71 flow across the width of the furnace in section II, as shown in FIGS. 5 to 7. The amount of oxygen used is typically from about 0.22 to 0.18 tons per ton of obtained matte.

In the slag converting section II, the last third portion, as shown in FIG. 4, top view, have no disposed lances in order to have some separation of the thin layer of slag from the enriched matte. The converter slag is continuously withdrawn via a tapping hole 6. This slag, or part of it, may be either granulated with water, ground and recycled to the smelting section I, as previously mentioned, or cooled slowly and treated by flotation for copper recovery.

Matte of controlled copper content, e.g. from 45% to 50% copper and about 28% to 20% iron (elemental metal basis, by weight), is continuously entering the slag converting section II. The flow of oxygen is adjusted for the almost complete oxidation and removal of iron in slag converting section II. Enriched matte, such as containing from 74 to 78% of copper, underflows the second partition 7 and enters into copper converting section III.

Unless specifically mentioned otherwise, wherever solids are discussed herein, the percentages of constituents are expressed by weight; wherever gases are discussed, the percentages of constituents are expressed by volume.

A significant fraction of contaminating impurities, like As, Sb, Bi, Pb, Zn, is typically fairly readily volatilized during the oxygen injection smelting in Section II and may be collected in the dust of the gas handling system. Impurities which do not volatilize during smelting will be oxidized and slagged off during the converting for slag in section II.

The thermal balance of section II may be controlled by the rate of water cooling of partitions. The rate of heat removal by water circulation should be such as to maintain about 1 to about 2" of solidified material on the immersed surface of the partition.

Furnace wall temperature may also be controlled at the slag level with water-cooled copper blocks. Air enriched with oxygen (70–80% $O_2$) instead of commercial oxygen (about 96% $O_2$) may further be used to achieve thermal balance.

The second partition 7, as previously discussed, consists of three sections 7(*a*), 7(*b*) and 7(*c*), and is designed to prevent the flow of converting slag into the copper converting section III. However, the second partition 7 allows the outflow of gas—through large openings 8 in each partition members 7*a*, *b* and *c* at its upper part (cf. FIGS. 6 and 8(*d*)) towards the single gas exit of the furnace 10, e.g. FIGS. 1 and 4. The enriched matte (white metal) is allowed to flow under one-third of the second partition 7 (see FIGS. 6 to 7) into the copper converting section III. However, separate gas collecting means may be used for Section III (not shown).

Oxygen flow is by injection through lances 11 positioned on the furnace roof in the copper converting section III. The rate of injection is controlled to produce a low sulfur content blister copper (e.g. from 1% to 3% sulfur) from the enriched matte.

The small quantity of (high-in-magnetite) slag 74 formed in section III (typically from about 60 to 70% magnetite) can be withdrawn occasionally from a skimming opening 12 placed in the furnace wall, e.g. side wall, as shown in FIGS. 1 and 10. This slag, low in quantity and high in copper content, is granulated, ground and recycled to the smelting section I.

Each partition 2 or 7 is composed of three sections each, 2(*a*), 2(*b*) and 2(*c*), and 7(*a*), 7(*b*) and 7(*c*), respectively. These sections are water-cooled copper blocks, of appropriate dimensions, fitted along their long sides as shown in FIGS. 8(*a*) to 8(*e*). Alternatively, suspended water-cooled sections of refractory material wall can serve as furnace partitions. Each copper block has its own water circulation. Boiler quality water is recommended. The temperature of water outflow should be continuously monitored, and if higher than a safe level, should trigger an alarm signal. In addition, thermocouples implanted at critical points of the partition blocks are for the purpose to indicate any alarming advance of thermal corrosion.

Figure 3:
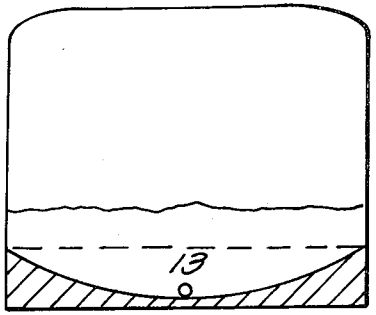
FIG. 3 is the right hand view of the furnace, shown in FIG. 1, schematically illustrating the end of the furnace where blister copper is removed via a tap-hole.

The furnace of appropriate refractories (these are well known in the art) is typically encased in a steel shell with special water-cooled sealed sleeves for lances on its roof to prevent air infiltration as illustrated in FIG. 9. The skimming opening 12, for the high magnetite slag, can be closed when not in use and restricted appropriately during skimming. The furnace operates always under a slightly negative pressure. The gas from the copper converting section III inflows via openings 8 into the slag converting section II and the overall converting gas flows through a connecting flue 9 and joins the gas of the smelting section at the furnace uptake 10, e.g. as shown in FIG. 1. A single stream of gas—at low volumetric flow rate and reasonably constant $SO_2$ content—is conducted to a single gas-handling system from uptake 10 and to the sulfur dioxide conversion and/or pollution control plant (not shown). Blister copper is withdrawn through the tap hole 13 (shown in FIGS. 1, 3 and 10).

A further embodiment of this invention, furnace B, has a short shaft 14, depicted in FIG. 10 in the smelting section I. A dry charge composed of fine concentrate mixed with dusts, ground secondaries and fluxes is injected with oxygen from the top of the shaft 14 via simple concentrate burner means, such as hot cyclones or pipes 15. The amounts thereof and their characteristics are shown such as in FIG. 13. The gas suspension of fine solids reacts very fast with oxygen. As the smelted droplets hit the surface of the bath, coagulation of similar phases and separation of matte from slag occur.

This furnace shown in FIG. 10 is also partitioned in three previously described distinct sections, i.e. smelting and settling section, slag converting and copper converting, labeled I, II, II, respectively.

The two partitions 2 and 7 are likewise designed for the furnace of FIG. 10, the same as for the furnace with horizontal charge injection shown in FIG. 1. The converting sections II and III are also designed and operated the same as in the furnace with horizontal charge injection and shown in FIGS. 5 to 8(*d*). In the smelting section I, FIG. 10, however, slag and matte flow cocurrently. Slag 70 is continuously tapped from a hole 16 on the side wall, e.g. under the gas uptake 10. Matte 71 underflows into the slag converting section II. The converting of matte to blister copper is conducted in the same way as in the furnace with horizontal charge injection and shown in FIG. 1.

EXAMPLE

The following specific example of a material and heat balance is illustrative, but not limiting, of the continuous production of blister copper in a single furnace by oxygen injection pursuant to the herein described invention.

Chalcopyrite concentrate (1400 ton/day) along with silic flux (72 ton/day) and concentrate recovered from the flotation of the converting slag (49 ton/day)—all dried to less than about 1% moisture—are injected with oxygen into the furnace.

The compositions of the components of the charge for the essential reactants are as follows:

| | Chalcopyrite Concentrate | Silica Flux | Converter Slag Concentrate |
|---|---|---|---|
| Cu | 27.0% | | 40.8% |
| Fe | 27.8 | | 32.0 |
| S | 32.7 | | 16.7 |
| $SiO_2$ | 4.9 | 80.0% | 13.9 |
| Other metallic oxides. | Bal. | Bal. | Bal. |

The calculated material balance is given in FIG. 13. The overall copper recovery is about 98.5%. The process is autothermal, with the overall consumption of 0.439 ton of commercial oxygen (97% $O_2$) per ton of fresh concentrate of the composition given above. Matte with about 45% Cu is produced in the smelting section I. The furnace slag with approximately 1.0% Cu and about 33% $SiO_2$ is rejected (it, however, may be treated by flotation if deemed desirable).

Air diluted oxygen (75% $O_2$) is injected, along with finely ground flux in the slag converting section II. The converting slag is cooled slowly and treated by flotation to recover about 92% of copper in this slag.

A single stream of product gas has a low flow rate of about 11,000 scfm (standard cubic feet per minute) and high $SO_2$ content (61.5% $SO_2$); this gas is removed via furnace gas uptake 10.

The heat balances of the three sections I, II and III, for the indicated rate of operation, are approximately as follows:

| | Million-Btu/hr |
|---|---|
| Smelting Section - I. | |
| Sensible heat in charge (177° F.) | 2.625 |
| in oxygen (77° F.) | 0. |
| Heat of reactions | 114.917 |
| Heat input | 117.542 |
| Latent heat of matte | 5.192 |
| of slag | 7.292 |
| of moisture evaporation | 1.225 |
| Sensible heat in matte (2,150° F.) | 23.625 |
| in slag (2,250° F.) | 20.417 |
| in dust (2,300° F.) | 1.692 |
| in reaction gases (2,300° F.) | 20.067 |
| in infiltrated air (2,300° F.) | 0.542 |
| Wall heat losses (by convection & cooling) | 37.490 |
| Heat output | 117.542 |
| Slag Converting - II. | |
| Sensible heat in matte (2,150° F.) | 23.625 |
| in enriched air & flux (77° F.) | 0. |
| Heat of reactions | 52.816 |
| Heat input | 76.441 |
| Latent heat of slag | 8.760 |
| Sensible heat in white metal (2,200° F.) | 10.527 |
| in slag (2,250° C.) | 24.528 |
| in product gas (2,350° F.) | 13.008 |
| Wall & partition heat losses (by convection & water cooling) | 19.618 |
| Heat output | 76.441 |
| Copper Converting - III. | |
| Sensible heat in white metal (2,200° F.) | 10.527 |
| in oxygen (77° F.) | 0. |
| Heat of reactions | 22.641 |
| Heat input | 33.168 |
| Sensible heat in blister (2,150° F.) | 7.606 |
| in product gas (2,300° F.) | 10.831 |
| Wall & partition heat losses (by convection & water cooling) | 14.731 |
| Heat output | 33.168 |

The above heat balances indicate that the process as described in autothermal, i.e. it leads to significant energy savings. The single source of concentrated $SO_2$ gas, it is presently believed, affords significant reductions in the cost of controlling the sulfur emission.

The process as described above is also applicable such as for obtaining nickel, i.e. crude nickel from sulfidic ores. Nickel thereafter is electrorefined or purified by vapor metallurgy.

All items in the drawings depicting this invention and which in the apparatus or the process perform the same function have been identified with same numerals.

What is claimed is:

1. A process for continuous production of metals, from sulfur-containing compounds, in a furnace consisting essentially of three zones, said process comprising the steps of:

a. feeding a metal concentrate containing sulfur, flux therefor and oxygen enriched gas, under sulfur burning conditions, into a first zone of a furnace for obtaining a molten slag and a molten metal matte, said first zone having a slag removal zone and a partition zone whereby a formed slag layer is confined within said first zone by said partition zone, but said metal matte is advanced to a second zone which zone is, with respect to said metal matte in said first zone, intercommunicating therewith;

b. recovering a $SO_2$ rich gas from said first zone;

c. injecting enriched oxygen containing gas or flux through a plurality of introduction zones into said second zone for converting sulfur and iron in said metal matte further into $SO_2$ and oxides of iron, and for converting other impurities associated with said metal matte into removable products removable from said metal sought to be obtained, said second zone being separated from said third zone by a partition zone interconnected with a third zone with respect to the metal product formed in said second zone but without intermixing of a slag layer formed in said second zone or a slag layer formed in said third zone;

d. recovering gaseous products rich in $SO_2$ gas from said second zone;

e. further injecting oxygen-containing gas into said third furnace zone for further refining the metal advanced from said second furnace zone, and forming a slag layer of said metal being refined;

f. collecting effluent gas from said third furnace zone;

g. collecting slag from said third furnace zone, and h. removing a metal thus refined from said furnace zone.

2. The process as defined in claim 1 wherein $SO_2$ rich gas is combined from all three furnace zones.

3. The process as defined in claim 1 wherein said second and third furnace zones are interconnecting with respect to the $SO_2$ rich gas formed in said second and third furnace zones.

4. The process as defined in claim 1 wherein said formed matte and said slag flows co-currently or countercurrently to each other in said first furnace zone.

5. The process as defined in claim 1 wherein a slag formed in said second furnace zone is treated for recovery of metal values in said slag and said recovered values are introduced into said first furnace zone as part of a concentrate charge therefor.

6. The process as defined in claim 1 wherein the slag in the third zone is treated to recover metal values therefrom.

7. The process as defined in claim 1 wherein in said second furnace zone flux is introduced together with oxygen and oxygen is also separately introduced into said second furnace zone.

8. The process as defined in claim 1 wherein dust is recovered from $SO_2$ rich gas recovered from said second and third furnace zones for introduction into said first furnace zone.

9. The process as defined in claim 1 wherein the metal being treated is copper.

10. The process as defined in claim 1 wherein the metal being treated is nickel.

11. A furnace apparatus for continuous smelting and converting of metal concentrates containing sulfur into a more refined metal product and for recovery of $SO_2$ rich gases, said apparatus comprising a furnace chamber of side walls, end walls, bottom and roof, and further of a first, a second and a third furnace section within said chamber, and oxygen-rich gas and concentrate introduction means for said first furnace section;

a slag removal means and a gas removal means for said first furnace section;

a first partition between said first and second furnace sections, said first partition comprising of a plurality of individual members with coolant passages in each and movable with respect to each other;

means for positioning said movable members for adjustment of space between a bottom of said furnace chamber and bottom of each of said movable members;

enriched oxygen-containing gas introduction means for said second furnace section;

flux introduction means for said second furnace section;

slag removal means for said second furnace section;

gas removal means for said second furnace section;

a second partition between said second and third furnace sections, said second partition comprised of a plurality of movable members with coolant passages in each and positionable with respect to each other for adjustment of space with respect to said bottom of said furnace chamber, said second partition defining said third furnace section with an end wall of said furnace chamber;

enriched oxygen-containing gas introduction means for said third furnace section;

slag removal means for said third furnace section;

a metal removal means for said third furnace section, and means for removing gas from said third furnace section.

12. The apparatus as defined in claim 11 wherein common gas removing means are for the first, second and third furnace sections.

13. The apparatus as defined in claim 11 wherein means for gas intercommunication are within said second furnace partition.

14. The apparatus as defined in claim 11 wherein the means for oxygen introduction are oxygen lances.

15. The apparatus as defined in claim 11 wherein said slag removal means for said first furnace section are in an end wall of said furnace chamber.

16. The apparatus as defined in claim 11 wherein said slag removal means for said first furnace section are in a side wall proximate to said first furnace partition.

17. The apparatus as defined in claim 11 wherein said means for introduction of oxygen and concentrate are in a wall of said furnace chamber.

18. The apparatus as defined in claim 11 wherein said means for introduction of oxygen and concentrate are in a dome intercommunicating with said first section and on roof of said furnace chamber.

19. The apparatus as defined in claim 17 wherein the means for introduction of oxygen and concentrate are in an end wall of said furnace opposite to said first furnace partition.

20. The apparatus as defined in claim 11 wherein the means for oxygen and concentrate introduction are hot cyclones.

21. The apparatus as defined in claim 11 wherein the means for oxygen and concentrate introduction are pipe burners.

22. The apparatus as defined in claim 11 wherein the means for oxygen introduction are water cooled lances.

* * * * *